US007946651B2

(12) United States Patent
Donati

(10) Patent No.: US 7,946,651 B2
(45) Date of Patent: May 24, 2011

(54) MECHANISM FOR ADJUSTING THE INCLINATION OF BACKRESTS IN CHAIRS AND ARM-CHAIRS, PARTICULARLY IN OFFICE CHAIRS

(75) Inventor: Armando Donati, Rodengo Salano (IT)

(73) Assignee: Donati S.p.A., Rodengo Salano (BS) (IT)

( * ) Notice: Subject to any disclaimer, the term of this patent is extended or adjusted under 35 U.S.C. 154(b) by 575 days.

(21) Appl. No.: 11/371,228

(22) Filed: Mar. 9, 2006

(65) Prior Publication Data

US 2006/0255636 A1 Nov. 16, 2006

(30) Foreign Application Priority Data

Apr. 27, 2005 (IT) ..... M12005A0751

(51) Int. Cl.
*A47C 1/024* (2006.01)

(52) U.S. Cl. ..... 297/301.1; 297/300.6; 297/302.5; 297/285

(58) Field of Classification Search ..... 297/301.1, 297/300.6, 301.5, 302.5, 300.1, 300.2, 285
See application file for complete search history.

(56) References Cited

U.S. PATENT DOCUMENTS

| | | | | |
|---|---|---|---|---|
| 4,384,741 | A * | 5/1983 | Flum et al. | 297/300.5 |
| 5,029,940 | A * | 7/1991 | Golynsky et al. | 297/300.4 |
| 5,080,318 | A * | 1/1992 | Takamatsu et al. | 248/598 |
| 5,209,548 | A * | 5/1993 | Locher | 297/300.4 |
| 5,782,536 | A * | 7/1998 | Heidmann et al. | 297/440.15 |
| 5,810,439 | A * | 9/1998 | Roslund, Jr. | 297/300.4 |
| 5,871,258 | A * | 2/1999 | Battey et al. | 297/317 |
| 5,873,634 | A * | 2/1999 | Heidmann et al. | 297/440.14 |
| 5,957,534 | A * | 9/1999 | Wilkerson et al. | 297/316 |
| 6,015,187 | A * | 1/2000 | Roslund et al. | 297/300.4 |
| 6,712,428 | B2 * | 3/2004 | Moreschi | 297/303.4 |
| 7,147,285 | B2 * | 12/2006 | Lin | 297/301.1 |
| 2004/0140702 | A1 * | 7/2004 | Daeschle et al. | 297/300.5 |

* cited by examiner

*Primary Examiner* — David Dunn
*Assistant Examiner* — Erika Garrett
(74) *Attorney, Agent, or Firm* — Nixon & Vanderhye P.C.

(57) ABSTRACT

The invention relates to a mechanism for an office chair or arm-chair, in which control means for the backrest inclination and spring means for biasing the backrest to the position of minimum inclination are provided, in which at least one stepped stop block can be moved in a controlled manner, a step of said block being suitable to interfere with a member connected to the backrest when the same is being inclined, in order to limit the stroke of said member between the position of minimum inclination of the backrest and a position of interference of the member connected to the backrest with a selected one of the block steps. The invention also relates to a method for transforming a locking mechanism to an end-of-stroke mechanism.

26 Claims, 3 Drawing Sheets

MECHANISM FOR ADJUSTING THE INCLINATION OF BACKRESTS IN CHAIRS AND ARM-CHAIRS, PARTICULARLY IN OFFICE CHAIRS

This application is a new US application claiming priority to IT MI2005A000741 filed 27 Apr. 2005, the entire contents of which are hereby incorporated by reference.

The present invention relates to a mechanism for controlling the movement of a chair/arm-chair backrest, particularly in office chairs, in which means are provided for controlling the backrest inclination, as well as spring means biasing the backrest to the position of minimum inclination.

Mechanisms of the above-mentioned type are known in which the backrest is inclined by the user and then locked in the selected position by acting on a knob, acting through releasable mechanical connections to generate a locking interference with a structural member that is connected with the backrest, in both directions and in any of a plurality of positions.

One aspect of the present invention is now to provide a mechanism to be applied to chairs and arm-chairs, particularly office chairs of the above-mentioned type, in which the inclination movement of the backrest, which is always controlled by the user pushing on the latter, is limited as desired, so that more positions of maximum inclination can be defined, the backrest automatically returning to the position of minimum inclination when the user's weight is no longer rested thereon. In other words, the mechanism according to this aspect of the invention allows the user to define in advance two or more points of maximum inclination for the backrest, thereafter the backrest can be inclined only to the maximum angle such as determined by the user's action.

A further aspect of the invention is a method for transforming a known type of locking mechanism such as discussed above in a mechanism for limiting the backrest inclination. The mechanism and the method of the invention further achieve the above-mentioned objects in a particularly easy and cost-effective manner.

The above-mentioned aspects and others are achieved by means of a type of mechanism and method having the functionalities as described herein.

Figure 1:
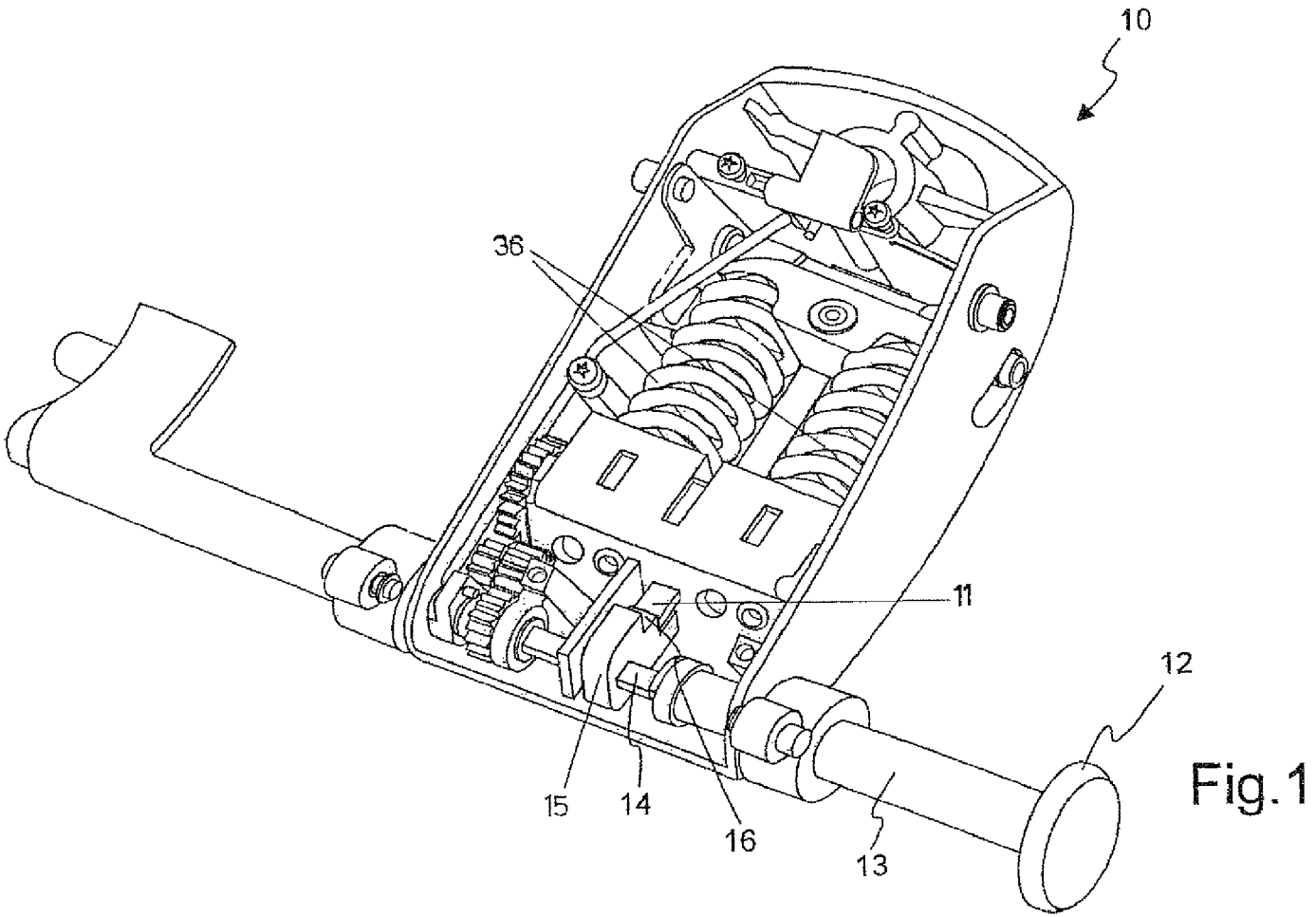
Figure 2:
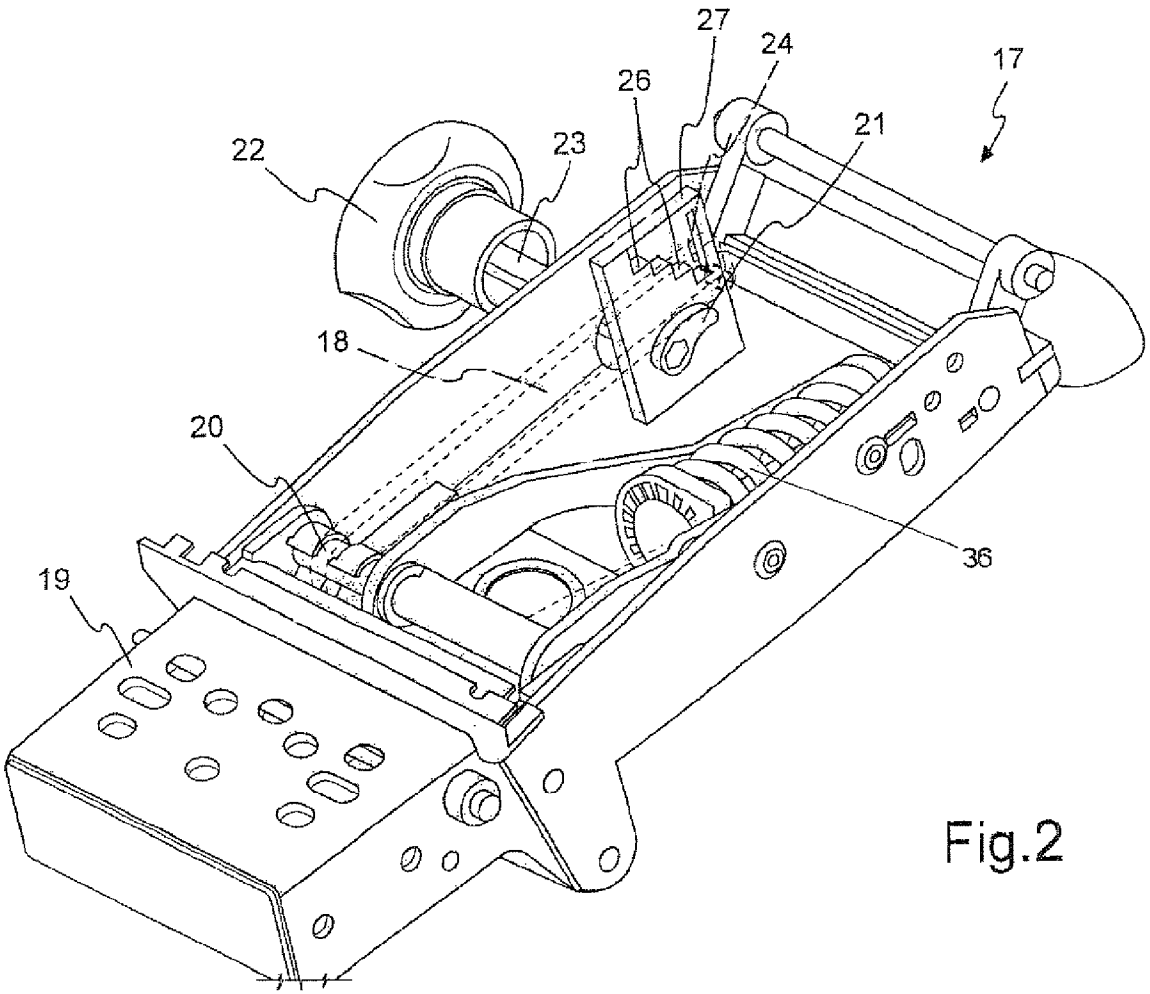
Figure 3:
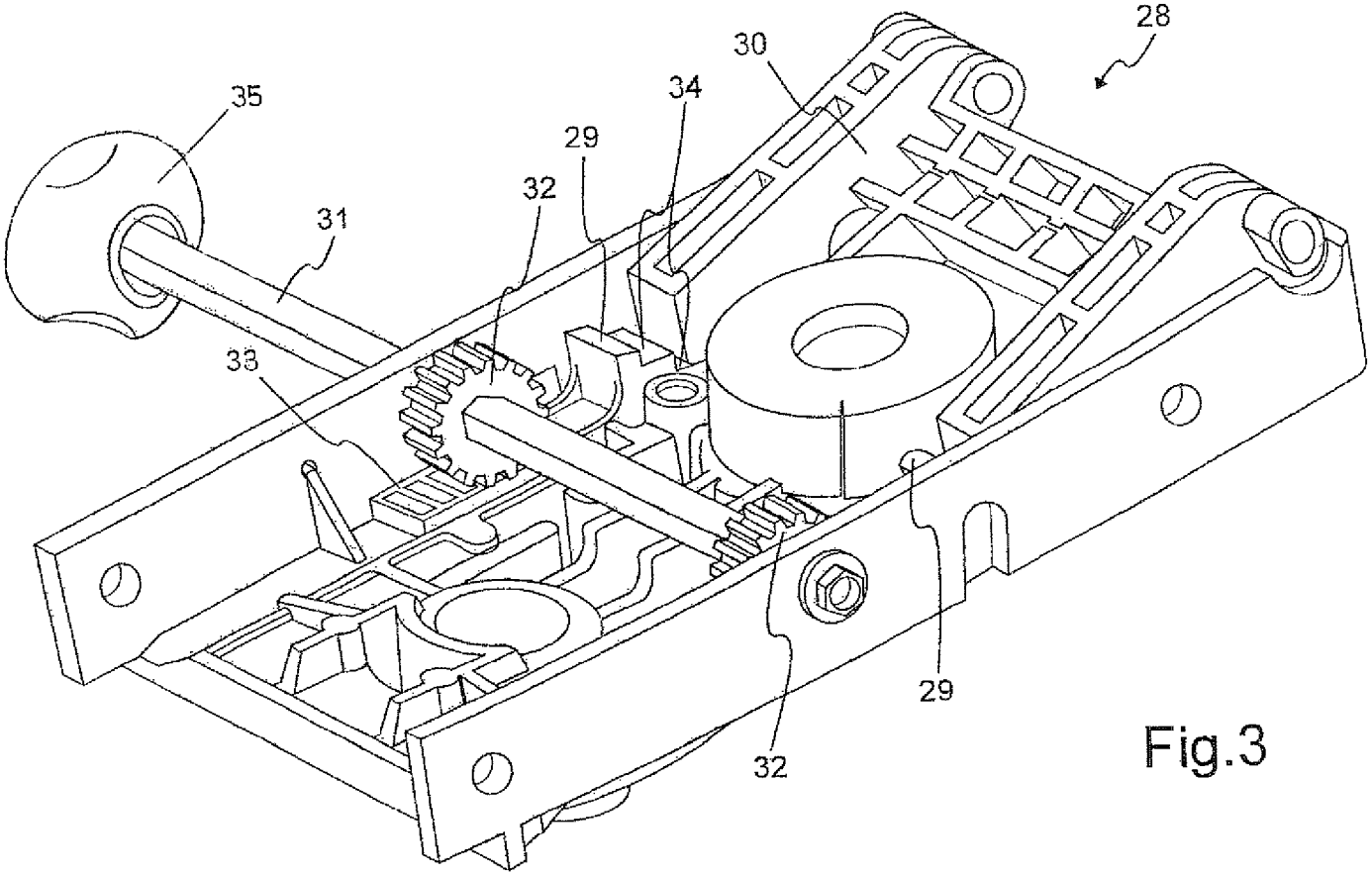

FIGS. 1 to 3 of the drawings are perspective views of three exemplary mechanisms for office chairs and the like, which have been modified for obtaining said end-of-stroke to the backrest.

More specifically, referring first to FIG. 1, a usual mechanism 10 for an office chair or arm-chair or the like is illustrated, which has been changed only in those parts intended for locking the inclination of the backrest such that an end-of-stroke is fitted for the backrest instead of this locking, such as discussed above. One or more springs 36 bias the backrest.

To this purpose, the lever 11, which is placed within the mechanism and connected to the seat such as to axially move when the backrest is inclined, is no longer locked in each position being reached, for example by means of a stop member that can be fitted between two adjacent teeth of a plurality of teeth carried by the lever, by the user acting on a knob 12 and a control rod 13.

To transform the locking device in an end-of-stroke device, it is sufficient that a rod 13 having a polygonal section, such as in 14, is provided and a block 15 is mounted thereon having a set of steps 16 facing the free end of the rod 11 such as to interfere with the movement of the free end thereof, the stroke of the rod being thus limited according to the step facing the same, which is selected by the user acting on the knob 12.

In the mechanism 17 of FIG. 2, a lever 18 (in dotted lines) is connected to the support 19 of the backrest and moves longitudinally according to the inclination of the latter. In the case of a locking mechanism, the lever is provided with a plurality of teeth, a stop device actuated by the user interfering therewith. On the other hand, in the case illustrated, the lever 18 is swingably pivoted in 20 and is controlled to raise from a cam 21 that can be actuated by a user by means of a knob 22 and a rod with a polygonal section 23. Then, the lever 18 has a pivot 24, which according to the inclination of the lever 18, is suitable to interfere with one of the steps of a fixedly mounted stepped block 27, in order to limit the stroke of the lever 18, and accordingly the inclination angle of the backrest in a consequent manner.

In FIG. 3 there is illustrated a further embodiment 28 in which two stepped blocks 29 are provided each acting in a parallel manner with one of their steps, directly on the support 30 of the backrest. Also in this case, the two blocks 29 are controlled by a rod having a polygonal section 31 that can be actuated by the user through a knob 35.

The rod 31 carries a pair of toothed pinions 32 which act on racks 33 integral with the blocks 29 to move the latter in the longitudinal direction and consequently have a desired one of the steps 34 at the free end of the support 30 in order to consequently limit the stroke of the latter and the seat.

The invention claimed is:

1. A mechanism for controlling the rearward movement caused by the user of a chair or armchair backrest, comprising control means for controlling the inclination of the backrest and spring means for biasing the backrest to a position of minimum inclination, said control means comprising:

a) at least one stop block having a plurality of steps arranged in a plane which is vertically perpendicular to the plane of the backrest, so said steps face toward the backrest or in an opposite direction to said backrest;

b) a lever being connected to said stop block for moving said stop block and allowing thereby the selection of a step of the stop block for setting a desired maximum inclination of the backrest; and c) a setting element being connected to the backrest and being movable along with the backrest for interfering with said selected step of the stop block in order to set said maximum inclination of the inclined backrest without locking it in said maximum inclination and allowing thereby the backrest to automatically return into the position of minimum inclination by said springs when the user's weight is no longer applied thereto.

2. A mechanism according to claim 1, wherein said lever comprises a rod with a polygonal cross-section.

3. A mechanism according to claim 1, wherein said setting element comprises a support of the backrest.

4. A mechanism according to claim 1, wherein said setting element comprises a lever connected to a support of the backrest.

5. A mechanism according to claim 1, wherein said lever consists of control means for controlling the block longitudinal movements.

6. A mechanism according to claim 5, wherein the block longitudinal movements are controlled in a direction perpendicular to the step interference surfaces, by means of a knob acting on a rack and pinion mechanism.

7. A mechanism according to claim 1, wherein said lever consists of control means for controlling block rotation.

8. A mechanism according to claim 7, wherein the means for controlling consists of a knob suitable to rotate a rod carrying the block.

9. A mechanism according to claim 1, wherein said lever includes means for moving a lever connectable to the backrest and interfering with one of the steps of a fixed block, by means of a pivot or projection.

10. A mechanism according to claim 9, wherein said lever moving means consists of a cam that is movable by the rotations of a drive knob and suitable to raise the lever in a direction substantially parallel to the step interference surfaces.

11. A mechanism according to claim 10, further comprising elastic means for returning the lever to the position of minimum inclination.

12. A mechanism according to claim 1, wherein said at least one stop block comprises a pair of stop blocks acting in a parallel manner.

13. A chair comprising:

a backrest, and the mechanism of claim 1.

14. A mechanism for controlling the rearward movement caused by the user of a chair or armchair backrest, comprising a controller to control the inclination of the backrest and a spring or biasing mechanism to bias the backrest to a position of minimum inclination, said controller consisting essentially of:

a) at least one stop block having a plurality of steps arranged in a plane which is vertically perpendicular to the plane of the backrest, so said steps face toward the backrest or in an opposite direction to said backrest;

b) a lever being connected to said stop block to move said stop block and to allow thereby the selection of a step of the stop block to set a desired maximum inclination of the backrest; and c) a setting element being connected to the backrest and being movable along with the backrest for interfering with said selected step of the stop block in order to set said maximum inclination of the inclined backrest without locking it in said maximum inclination and to thereby allow the backrest to automatically return into the position of minimum inclination by said springs when the user's weight is no longer applied thereto.

15. A mechanism according to claim 14, wherein said lever comprises a rod with a polygonal cross-section.

16. A mechanism according to claim 14, wherein said setting element comprises a lever connected to a support of the backrest.

17. A mechanism according to claim 14, wherein said setting element comprises a support of the backrest.

18. A mechanism according to claim 14, wherein said lever includes a control to control the block longitudinal movements.

19. A mechanism according to claim 18, wherein the block longitudinal movements are controlled in a direction perpendicular to one or more step interference surfaces, using a knob acting on a rack and pinion mechanism.

20. A mechanism according to claim 14, wherein said lever includes a control to control block rotation.

21. A mechanism according to claim 20, wherein block rotation control includes a knob suitable to rotate a rod carrying the block.

22. A mechanism according to claim 14, including structure to move the lever and interfere with one of the steps of a fixed block, using a pivot or projection.

23. A mechanism according to claim 22, including a cam that is movable by the rotations of a drive knob and suitable to raise the lever in a direction substantially parallel to the step interference surfaces.

24. A mechanism according to claim 23, further comprising an elastic member to return the lever to the position of minimum inclination.

25. A mechanism according to claim 14, wherein said at least one stop block comprises a pair of stop blocks acting in a parallel manner.

26. A chair comprising:

a backrest, and the mechanism of claim 14.

* * * * *